US008712274B2

(12) United States Patent
Ito

(10) Patent No.: US 8,712,274 B2
(45) Date of Patent: Apr. 29, 2014

(54) IMAGE RECORDING DEVICE, IMAGE RECORDING METHOD, AND COMPUTER PROGRAM PRODUCT THAT ADDS A FLUORESCENT-WHITENING-AGENT ONTO A RECORDING SHEET

(75) Inventor: Takanori Ito, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 203 days.

(21) Appl. No.: 13/316,923

(22) Filed: Dec. 12, 2011

(65) Prior Publication Data

US 2012/0155908 A1 Jun. 21, 2012

(30) Foreign Application Priority Data

Dec. 15, 2010 (JP) ..... 2010-279618

(51) Int. Cl.
*G03G 15/00* (2006.01)

(52) U.S. Cl.
USPC ..... 399/81

(58) Field of Classification Search
USPC ..... 399/81
See application file for complete search history.

(56) References Cited

U.S. PATENT DOCUMENTS 5,290,750 A * 3/1994 Kushi et al. ..... 503/227
5,463,480 A * 10/1995 MacDonald et al. ..... 358/520
5,518,981 A * 5/1996 Nelson et al. ..... 503/201
6,567,543 B1 * 5/2003 Shiraiwa et al. ..... 382/167
2003/0020727 A1 * 1/2003 Newman ..... 345/604
2009/0153906 A1 * 6/2009 Ito ..... 358/3.01
2009/0284812 A1 * 11/2009 Tsukamoto ..... 358/518

FOREIGN PATENT DOCUMENTS

JP 4-349474 12/1992
JP 04349474 A * 12/1992 ..... G03G 15/01
JP 8-248727 9/1996
JP 2009-278362 11/2009
JP 2012108340 A * 6/2012

* cited by examiner

*Primary Examiner* — David Gray
*Assistant Examiner* — Tyler Hardman
(74) *Attorney, Agent, or Firm* — Oblon, Spivak, McClelland, Maier & Neustadt, L.L.P.

(57) ABSTRACT

An image recording device records an image on a recording sheet based on input image information. The image recording device includes: an illumination-light-information inputting unit that inputs information of illumination light when the recorded image is observed; a whiteness setting unit that sets a whiteness of the recording sheet when the recorded image is observed; an addition amount determining unit that determines an amount of fluorescent-whitening-agent to be added to the recording sheet based on the input information of the illumination light and the whiteness that is set; and a fluorescent-whitening-agent adding unit that adds an amount of fluorescent-whitening-agent onto the recording sheet according to the determined amount of fluorescent-whitening-agent.

5 Claims, 10 Drawing Sheets

IMAGE RECORDING DEVICE, IMAGE RECORDING METHOD, AND COMPUTER PROGRAM PRODUCT THAT ADDS A FLUORESCENT-WHITENING-AGENT ONTO A RECORDING SHEET

CROSS-REFERENCE TO RELATED APPLICATIONS

The present application claims priority to and incorporates by reference the entire contents of Japanese Patent Application No. 2010-279618 filed in Japan on Dec. 15, 2010.

BACKGROUND OF THE INVENTION

1. Field of the Invention

The present invention relates to an image recording device, an image recording method, and a computer program product for recording an image with appropriate whiteness.

2. Description of the Related Art

There are various kinds of recording sheets which are used in image recording devices and with which a fluorescent-whitening-agent is mixed to improve the degree of whiteness. The user uses the recording sheets according to taste. The reason is as follows. As the degree of whiteness of the recording sheet increases, a color reproduction range is widened and image quality is improved. On the other hand, when the degree of whiteness is high, the high degree of whiteness irritates the human eyes, which results in low visibility. However, the effect obtained by the degree of whiteness (fluorescent-whitening-agent) is affected by illumination light when the recording sheet having an image recorded thereon is observed.

In addition, there is a technique which adds the fluorescent-whitening-agent using the image recording device to improve the degree of whiteness, instead of changing the recording sheet. For example, Japanese Patent Application Laid-open No. 4-349474 discloses a technique which covers the entire surface of a recording sheet or a light-colored portion of the image with toner including a fluorescent-whitening-agent, thereby improving the degree of whiteness of the recording sheet.

However, the apparatus which adds the fluorescent-whitening-agent onto the recording sheet does not control the amount of fluorescent-whitening-agent added. Therefore, the degree of whiteness is insufficient or over-sufficient by the influence of illumination light during observation and the amount of fluorescent-whitening-agent. As a result, an appropriate degree of whiteness is not obtained.

SUMMARY OF THE INVENTION

It is an object of the present invention to at least partially solve the problems in the conventional technology.

An image recording device records an image on a recording sheet based on input image information. The image recording device includes: an illumination-light-information inputting unit that inputs information of illumination light when the recorded image is observed; a whiteness setting unit that sets a whiteness of the recording sheet when the recorded image is observed; an addition amount determining unit that determines an amount of fluorescent-whitening-agent to be added to the recording sheet based on the input information of the illumination light and the whiteness that is set; and a fluorescent-whitening-agent adding unit that adds an amount of fluorescent-whitening-agent onto the recording sheet according to the determined amount of fluorescent-whitening-agent.

An image recording method records an image on a recording sheet based on input image information. The method includes: inputting information of illumination light when the recorded image is observed; setting a whiteness of the recording sheet when the recorded image is observed; determining an amount of fluorescent-whitening-agent to be added to the recording sheet based on the input information of the illumination light and a set whiteness that is set at the setting; and adding fluorescent-whitening-agent to the recording sheet according to an amount of fluorescent-whitening-agent determined at the determining.

A computer program product includes a non-transitory computer-usable medium having computer-readable program codes embodied in the medium for image recording in an image recording device. The program codes, when executed, causes a computer to execute the image recording method mentioned above.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, exemplary embodiments will be described in detail with reference to the accompanying drawings. In the embodiment, when an image recording device adds a fluorescent-whitening-agent to a recording sheet (transfer sheet), the amount of fluorescent-whitening-agent is determined on the basis of information related to illumination light when the recording sheet having an image recorded thereon is observed and the fluorescent-whitening-agent is added to the recording sheet.

First Embodiment

Figure 1:
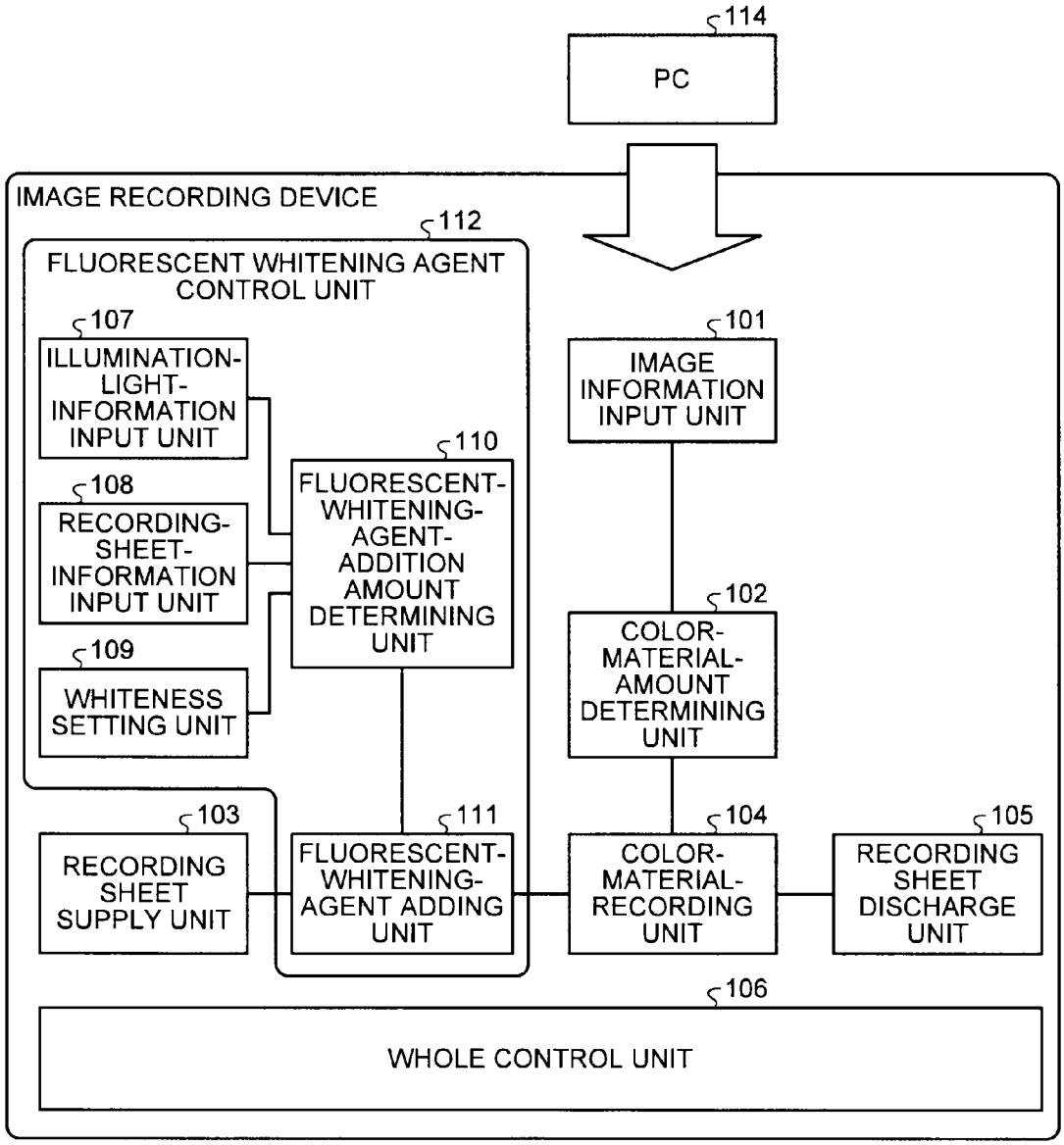
FIG. 1 is a diagram illustrating the structure of an image recording device according to an embodiment of the invention.

FIG. 1 is a diagram illustrating the structure of an image recording device according to an embodiment. An image information inputting unit 101 receives compressed/decompressed image data or an image drawing command from, for example, a personal computer (PC) 114; develops the data to red (R), green (G), and blue (B) bitmap image data; and outputs the developed R, G, and B image data. A color-material-amount determining unit 102 determines the recording amount of, for example, CMYK color materials of the image recording device on the basis of the developed RGB image data and outputs the recording amount as CMYK bitmap image data. A recording-sheet supply unit 103 stores recording sheets (transfer sheets) and supplies the recording sheets to a color-material recording unit 104, which will be described below.

The color-material recording unit 104 records color materials on the recording sheet supplied from the recording-sheet supply unit 103 on the basis of the bitmap image data output from the color-material-amount determining unit 102, using a recording system, such as an electrophotographic system or an ink jet system. A recording sheet discharge unit 105 discharges and holds the recording sheet on which the color materials are recorded by the color-material recording unit 104. A whole control unit 106 is, for example, a microcomputer system and controls each of the above-mentioned blocks to function as the image forming apparatus.

The above is the structure of the general image recording device. However, the image recording device according to the embodiment further includes a fluorescent-whitening-agent control unit 112. The fluorescent-whitening-agent control unit 112 includes an illumination-light-information inputting unit 107, a recording-sheet-information inputting unit 108, a whiteness setting unit 109, a fluorescent-whitening-agent-addition-amount determining unit 110, and a fluorescent-whitening-agent adding unit 111.

The image recording device including the image information inputting unit 101 and the color-material-amount determining unit 102 has been described above. However, the embodiment may be applied to an image recording device that receives compressed/decompressed image data or an image drawing command from, for example, the PC 114 and directly develops the received data to CMYK bitmap image data.

The illumination-light-information inputting unit 107 inputs the information of illumination light, when the recording sheet having color materials recorded thereon is observed, into the fluorescent-whitening-agent-addition-amount determining unit 110, which will be described below. The information of the illumination light includes at least information required to know the spectral distribution of the illumination light. Specifically, the information of the illumination light includes information, such as a spectral distribution, the type of illumination light source (for example, D50, F2, F8, and F10), and a color rendering property/a light source color (for example, a common white, a three-wavelength natural white, or a high color rendering natural white).

The recording-sheet-information inputting unit 108 inputs the information of the recording sheet stored in the recording-sheet supply unit 103 into the fluorescent-whitening-agent-addition-amount determining unit 110. The information of the recording sheet includes at least information required to know the degree of whiteness of the recording sheet. Specifically, the information of the recording sheet is acquired by the following methods: a sensor provided in the recording-sheet supply unit 103 or a supply path of the recording sheet reads the recording sheet and detects the degree of whiteness; the user inputs the degree of whiteness of the recording sheet; and the user inputs the type of recording sheet. As such, since the fluorescent-whitening-agent-addition-amount determining unit 110 can determine the amount of fluorescent-whitening-agent to be added to the recording sheet on the basis of the information of the recording sheet, it is possible to record an image with an appropriate degree of whiteness, regardless of the type of recording sheet.

The whiteness setting unit 109 inputs, to the fluorescent-whitening-agent-addition-amount determining unit 110, the whiteness setting information of the recording sheet when the recording sheet having a color material recorded thereon is observed. The whiteness of the recording sheet depends on the amount of fluorescent-whitening-agent added. As the amount of fluorescent-whitening-agent increases, blueness increases and the recording sheet seems to be whiter. On the contrary, as the amount of fluorescent-whitening-agent is reduced, yellowness increases and the recording sheet seems to be colored by an influence of a color of primitive paper (or Ecru, which is a color of shade greyish-pale yellow or a light greyish-yellowish brown). In addition, the whiteness of the recording sheet depends on the spectral distribution of illumination light during observation or the original degree of whiteness of the recording sheet (before the fluorescent-whitening-agent is added). The whiteness setting information of the recording sheet is for setting whiteness when the user actually observes the recording sheet having a color material recorded thereon under the above-mentioned conditions.

The fluorescent-whitening-agent-addition-amount determining unit 110 determines the amount of fluorescent-whitening-agent to be added to the recording sheet on the basis of the illumination light information input from the illumination-light-information inputting unit 107, the recording sheet information input from the recording-sheet-information inputting unit 108, and the whiteness setting information input from the whiteness setting unit 109 and outputs the determined amount of fluorescent-whitening-agent to the fluorescent-whitening-agent adding unit 111.

For example, the fluorescent-whitening-agent-addition-amount determining unit 110 determines the amount of fluorescent-whitening-agent as follows such that the whiteness set by the whiteness setting unit 109 is satisfied. In the case of illumination light with an effect of improving the degree of whiteness (fluorescent-whitening-agent), that is, in the case of illumination light capable of generating a large amount of fluorescence in which the intensity in a range from ultraviolet light to light with a blue wavelength is high, the fluorescent-whitening-agent-addition-amount determining unit 110 reduces the amount of fluorescent-whitening-agent. In the case of illumination light capable of generating a small amount of fluorescence in which the intensity in a range from ultraviolet light to light with a blue wavelength is low, the fluorescent-whitening-agent-addition-amount determining unit 110 increases the amount of fluorescent-whitening-agent.

The fluorescent-whitening-agent adding unit 111 adds the amount of fluorescent-whitening-agent determined by the fluorescent-whitening-agent-addition-amount determining unit 110 onto the recording sheet supplied from the recording-sheet supply unit 103 using a recording system, such as an electrophotographic system or an ink jet system.

The image recording device is close to a type in which, after a recording sheet with a desired degree of whiteness is selected, color materials are recorded on the recording sheet. Therefore, after the fluorescent-whitening-agent is added to the recording sheet, color materials are recorded on the recording sheet. However, after color materials are recorded on the recording sheet, the fluorescent-whitening-agent may be added.

Figure 2A:
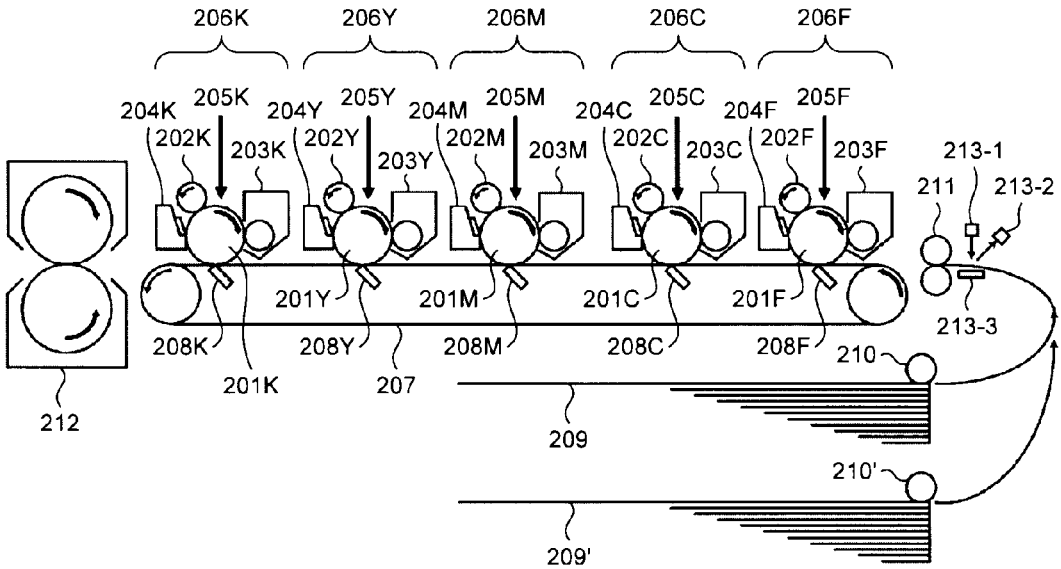
FIGS. 2A and 2B are diagrams illustrating a mechanism portion of the image recording device that performs the recording of a color material and the addition of a fluorescent-whitening-agent using an electrophotographic system.

FIG. 2A is a cross-sectional view illustrating a mechanism portion of the image recording device that performs the recording of color materials and the addition of the fluorescent-whitening-agent using the electrophotographic system. In FIG. 2A, reference numerals 201F, 201C, 201M, 201Y, and 201K indicate drum-shaped photosensitive elements (electrophotographic photosensitive elements) and the photosensitive elements 201F, 201C, 201M, 201Y, and 201K are rotated in the direction of an arrow in FIG. 2A. At least charging rollers 202F, 202C, 202M, 202Y, and 202K, developing units 203F, 203C, 203M, 203Y, and 203K, and cleaning units 204F, 204C, 204M, 204Y, and 204K are sequentially arranged around the photosensitive elements in the rotation direction.

The charging rollers 202F, 202C, 202M, 202Y, and 202K form a charging device for uniformly charging the surfaces of the photosensitive elements. An exposure device (not shown) emits laser beams 205F, 205C, 205M, 205Y, and 205K to the surfaces of the photosensitive elements between the charging rollers 202F, 202C, 202M, 202Y, and 202K and the developing units 203F, 203C, 203M, 203Y, and 203K to form electrostatic latent images on the photosensitive elements 201F, 201C, 201M, 201Y, and 201K, respectively.

The developing units 203F, 203C, 203M, 203Y, and 203K form a developing device for forming toner images on the surfaces of the photosensitive elements on the basis of the electrostatic latent images. The cleaning units 204F, 204C, 204M, 204Y, and 204K form a cleaning device for removing toner remaining on the surfaces of the photosensitive elements.

Five image forming units 206F, 206C, 206M, 206Y, and 206K having the photosensitive elements 201F, 201C, 201M, 201Y, and 201K as the main components are arranged along a transfer/conveying belt 207, which is a recording sheet conveying unit.

The transfer/conveying belt 207 comes into contact with the photosensitive elements 201F, 201C, 201M, 201Y, and 201K between the developing units 203F, 203C, 203M, 203Y, and 203K and the cleaning units 204F, 2040, 204M, 204Y, and 204K in the image forming units 206F, 206C, 206M, 206Y, and 206K. Transfer brushes 208F, 208C, 208M, 208Y, 208K for applying a transfer bias are provided on the surface (rear surface) of the transfer/conveying belt 207 opposite to the photosensitive elements.

Basically, the image forming units 206F, 206C, 206M, 206Y, and 206K have the same structure, but different color toners are stored in the developing units in the image forming units 206F, 206C, 206M, 206Y, and 206K.

Next, an image forming operation of the image recording device shown in FIG. 2A will be described. First, in the image forming units 206F, 206C, 206M, 206Y, and 206K, the photosensitive elements 201F, 201C, 201M, 201Y, and 201K are respectively charged by the charging rollers 202F, 202C, 202M, 202Y, and 202K which are rotated in the direction of an arrow (the circumferential direction together with the photosensitive element), and electrostatic latent images corresponding to an image to be formed are formed by the laser beams 205F, 205C, 205M, 205Y, and 205K emitted by the exposure device.

Then, the developing units 203F, 203C, 203M, 203Y, and 203K develop the latent images to form toner images. The developing units 203F, 203C, 203M, 203Y, and 203K develop the toner images using F (fluorescent-whitening-agent), C (cyan), M (magenta), Y (yellow), and K (black) toners. The toner images formed on the five photosensitive elements 201F, 201C, 201M, 201Y, and 201K are delivered to contact positions with the transfer/conveying belt 207.

A recording sheet 209 is delivered from a tray by a feed roller 210, is temporarily stopped at a pair of registration rollers 211, and is delivered to the transfer/conveying belt 207 in synchronization with the formation of images on the photosensitive elements.

The recording sheet 209 held on the transfer/conveying belt 207 is conveyed and the toner images are transferred at contact positions (transfer portions) with the photosensitive elements 201F, 201C, 201M, 201Y, and 201K. At that time, the toner images on the photosensitive elements are transferred onto the recording sheet 209 by the electric field formed by the potential difference between the transfer bias applied to the transfer brushes 208F, 2080, 208M, 208Y, and 208K and the photosensitive elements 201F, 201C, 201M, 201Y, and 201K.

Then, the recording sheet 209 which passes through the five transfer portions and on which five kinds of toner images overlap each other is conveyed to a fixing device 212 and the toner is fixed by the fixing device 212. Then, the recording sheet 209 is discharged to a sheet discharge portion (not shown).

The toner which remains on the photosensitive elements 201F, 201C, 201M, 201Y, and 201K without being transferred in the transfer portions is collected by the cleaning units 204F, 204C, 204M, 204Y, and 204K and is reused.

In the example shown in FIG. 2A, the image forming units are sequentially arranged in the order of F (fluorescent-whitening-agent), C (cyan), M (magenta), Y (yellow), and K (black) from the upstream side to the downstream side in the direction in which the recording sheet is conveyed, but the arrangement order is not limited thereto. The arrangement order may be arbitrarily set.

When an image to which no fluorescent-whitening-agent is added is formed, the image forming unit 206F may be stopped, or a mechanism for separating the photo sensitive element 201F from the transfer/conveying belt 207 may be provided to separate the photo sensitive element 201F from the transfer/conveying belt 207.

Figure 2B:
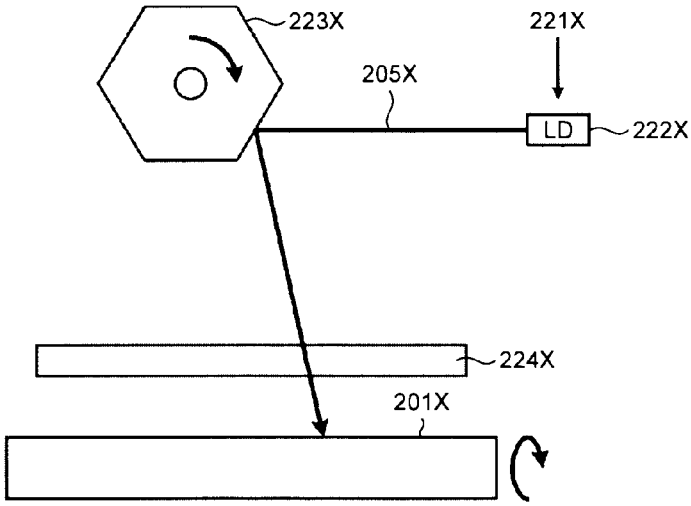

An example of the exposure device which is not shown in FIG. 2A is shown in FIG. 2B. In FIG. 2B, a laser beam 205X (corresponding to one of the laser beams 205F, 205C, 205M, 205Y, and 205K) emitted from a laser diode (LD) 222X which is biased by an image signal 221X is reflected from a polygon mirror 223X, passes through an fθ lens 224X or a mirror (not shown), and is focused on a photosensitive element drum 201X (corresponding to one of the photosensitive elements 201F, 201C, 201M, 201Y, and 201K).

The polygon mirror 223X is rotated in the direction of an arrow and the laser beam is emitted in a direction perpendicular to the rotation direction of the photosensitive element drum 201X, that is, in a direction along the drum axis by the rotation of the polygon mirror. Then, a two-dimensional electrostatic latent image is formed on the photosensitive element drum 201X by the rotation of the photo sensitive element drum and the rotational scanning of the polygon mirror.

The image recording device shown in FIG. 2A corresponds to the recording-sheet-information inputting unit 108 and includes a whiteness sensor 213 that detects the degree of whiteness of the recording sheet.

The whiteness sensor 213 shown in FIG. 2A includes, for example, a blue LED 213-1, a photoelectric sensor 213-2 and a reference white board 213-3 based on a Hunter color system and has a structure in which light emitted from the blue LED 213-1 with a peak wavelength of about 470 nm is reflected from the reference white board 213-3 or the recording sheet 209 and is then incident on the photoelectric sensor 213-2. The reference white board 213-3 and the recording sheet 209 calculate the ratio of the magnitude of the signal which is subjected to photoelectric conversion in the photoelectric sensor 213-2 and is then output, and the degree of whiteness of the recording sheet 209 is estimated on the basis of the ratio and the known degree of whiteness of the reference white board 213-3 which has been measured in advance.

The whiteness sensor 213 may be arranged immediately after the feed roller 210. However, as described above, in the structure in which the whiteness sensor 213 is arranged immediately before the registration roller 211, when other feed mechanisms, such as a recording sheet 209' and a feed roller 210', are provided, the whiteness sensor 213 can be shared by the components. Therefore, it is possible to reduce manufacturing costs.

An example of the whiteness sensor based on the Hunter color system has been described above. However, a halogen lamp or a xenon lamp may be used instead of the blue LED to emit light in a wide wavelength range and the light may be received to detect the degree of whiteness.

Figure 3A:
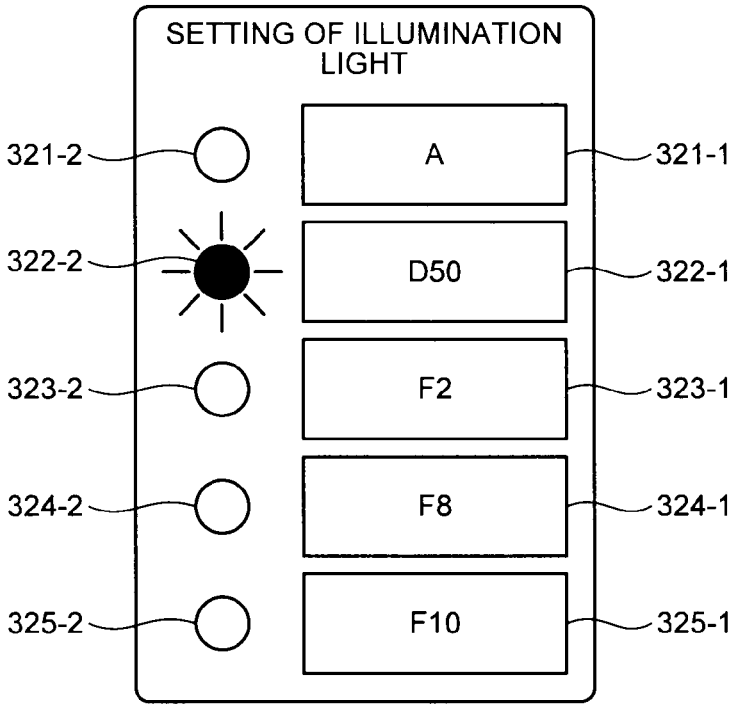
FIGS. 3A to 3D are diagrams illustrating the outward appearance of an illumination-light-information inputting unit and the outward appearance of a whiteness setting unit.

FIG. 3A is a diagram illustrating an example of the outward appearance of the illumination-light-information inputting unit 107. Referring to FIG. 3A, key SWs (switches) 321-1 to 325-1 are switches for setting illumination light when the recording sheet having a color material recorded thereon is observed and correspond to an A light source (321-1), a D50 light source (322-1), an F2 light source (323-1), an F8 light source (324-1), and an F10 light source (325-1), respectively. During observation, the operator determines the kind of illumination light and presses any one of the key SWs 321-1 to 325-1.

When detecting this operation, the illumination-light-information inputting unit 107 turns on the corresponding indicator lamps 321-2 to 325-2 to notify the operator that the operation has been recognized. In addition, the illumination-light-information inputting unit 107 outputs illumination light information to the fluorescent-whitening-agent-addition-amount determining unit 110. In the example shown in FIG. 3A, the kind of illumination light is input, but the embodiment is not limited thereto.

Figure 3B:
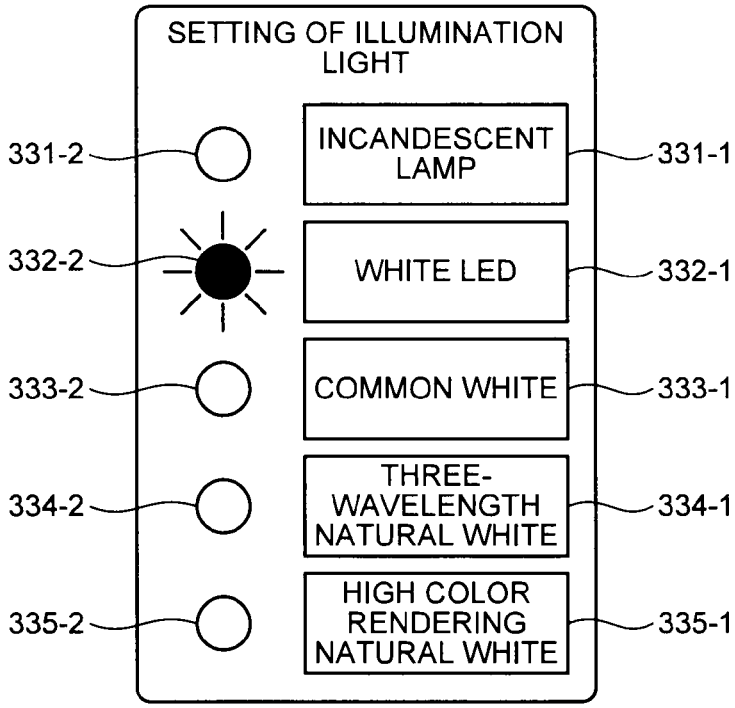

FIG. 3B is a diagram illustrating another example of the outward appearance of the illumination-light-information inputting unit 107. Referring to FIG. 3B, key SWs 331-1 to 335-1 are switches for setting illumination light when the recording sheet having a color material recorded thereon is observed and correspond to an incandescent lamp (331-1), a white LED (332-1), a common white fluorescent lamp (333-1), a three-wavelength natural white fluorescent lamp (334-1), and a high color rendering natural white fluorescent lamp (335-1). During observation, the operator determines the color rendering property of illumination light and the color (type) of a light source and presses any one of the key SWs 331-1 to 335-1.

When detecting this operation, the illumination-light-information inputting unit 107 turns on the corresponding indicator lamps 331-2 to 335-2 to notify the operator that the operation has been recognized. In addition, the illumination-light-information inputting unit 107 outputs illumination light information to the fluorescent-whitening-agent-addition-amount determining unit 110. As such, since only the operation of specifying illumination light when a recorded image is observed is performed, it is possible to easily achieve an illumination-light-information inputting unit.

Figure 3C:
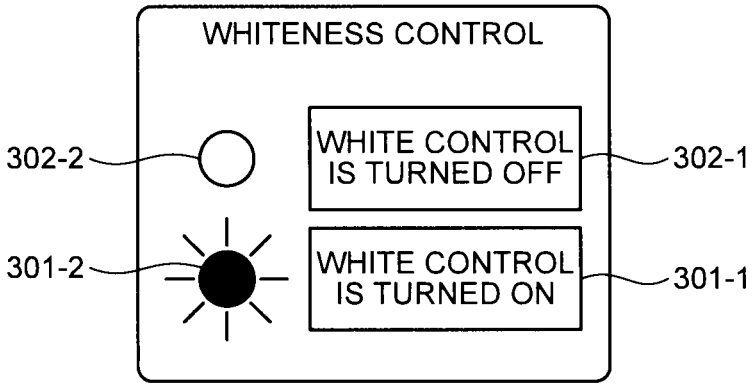

FIG. 3C is a diagram illustrating an example of the outward appearance of the whiteness setting unit 109. Referring to FIG. 3C, key SWs (switches) 301-1 and 302-1 are switches for setting whether to add the fluorescent-whitening-agent to control the whiteness of the recording sheet (ON: 301-1) or not (OFF: 302-1). The operator determines whether whiteness control is needed and presses any one of the key SWs 301-1 and 302-1.

The whiteness setting unit 109 detects this operation, turns on the corresponding indicator lamps 301-2 and 302-2 to notify the operator that the operation has been recognized, and outputs the ON/OFF setting information of the whiteness control to the fluorescent-whitening-agent-addition-amount determining unit 110. In the example shown in FIG. 3C, when the whiteness control is performed for the recording sheet, target whiteness is predetermined. However, the embodiment is not limited thereto.

Figure 3D:
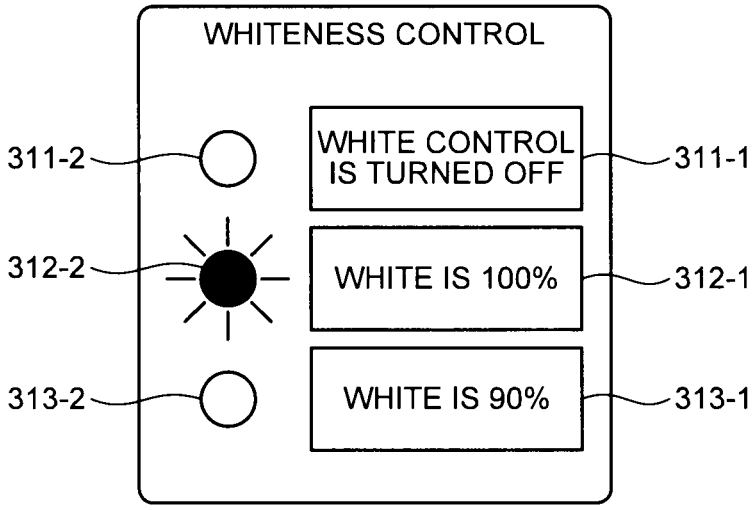

FIG. 3D is a diagram illustrating another example of the outward appearance of the whiteness setting unit 109. Referring to FIG. 3D, key SWs (switches) 311-1, 312-1, and 313-1 are switches for setting an operation that does not add the fluorescent-whitening-agent to control the whiteness of the recording sheet (OFF: 311-1), an operation of setting the target value of the whiteness control to 100% (ON: 312-1), and an operation of setting the target value of the whiteness control to 90% (ON: 313-1). The operator determines whether whiteness control is needed and presses any one of the key SWs 311-1 to 313-1.

The whiteness setting unit 109 shown in FIG. 3D detects the operation, turns on the corresponding indicator lamps 311-2 to 313-2 to notify the operator that the operation has been recognized, and outputs a whiteness control target value or OFF setting information to the fluorescent-whitening-agent-addition-amount determining unit 110.

As described above, the whiteness of the recording sheet depends on, for example, the spectral distribution of illumination light during observation, the original degree of whiteness of the recording sheet, and the amount of fluorescent-whitening-agent added. For example, in the embodiment, when the spectral distribution of illumination light during the observation of the recording sheet is $L(\lambda)$, the representative spectral reflectivity of the recording sheet is $R(W, \lambda)$ (where W is the original degree of whiteness of the recording sheet), and a spectral absorption/radiation component of the fluorescent-whitening-agent by illumination light $L(\lambda)$ is $F(A, L, \lambda)$ (where A is the amount of fluorescent-whitening-agent), reflectance at 457 nm is calculated as follows and is used as an index of whiteness for control:

$$(\text{Whiteness})=(L(457)\cdot R(W,457)+F(A,L,457))/L(457)\times 100 \quad (1)$$

Figure 4A:
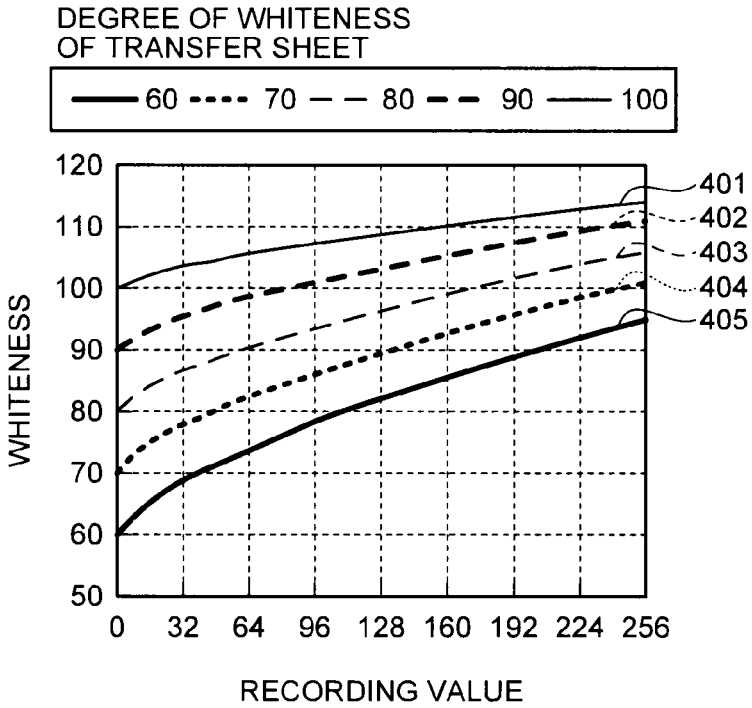
FIGS. 4A and 4B are diagrams illustrating the relation between the amount of fluorescent-whitening-agent added and whiteness.
Figure 4B:
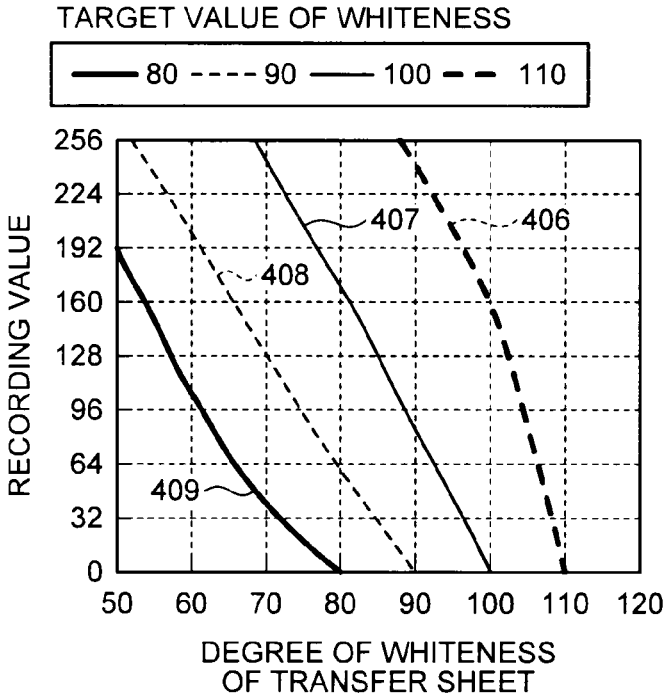

FIGS. 4A and 4B are diagrams illustrating the relation between the amount (recording value) of fluorescent-whitening-agent added and whiteness. FIG. 4A shows an example of the relation between the recording amount of fluorescent-whitening-agent and the whiteness of the recording sheet after the fluorescent-whitening-agent is added when the fluorescent-whitening-agent is added to recording sheets with various degrees of whiteness (in this embodiment, 60%, 70%, 80%, 90%, and 100%) in the image recording device. Lines 401 to 405 indicate the relation between the recording amount and whiteness when the degree of whiteness of the recording sheet is from 100% to 60%. In this embodiment, since the spectral distribution of illumination light when the recording sheet is observed is the same as that when the degree of whiteness of the recording sheet is measured, whiteness when the recording amount of fluorescent-whitening-agent is 0 is the same as the degree of whiteness.

As shown in FIGS. 4A and 4B, as the amount of fluorescent-whitening-agent increases, the whiteness of the recording sheet after the fluorescent-whitening-agent is added increases. When the same recording amount of fluorescent-whitening-agent is added, the recording sheet with a higher degree of original whiteness has higher whiteness after the fluorescent-whitening-agent is added. In this embodiment, the maximum value of the recording amount of fluorescent-whitening-agent is normalized to 255 and the whiteness of the recording sheet when the maximum amount of fluorescent-whitening-agent is added depends on the original degree of whiteness of the recording sheet. In addition, even when the fluorescent-whitening-agent is added, the degree of whiteness is not less than the original degree of whiteness of the recording sheet. This shows that the range of whiteness which can be controlled by the addition of the fluorescent-whitening-agent depends on the original degree of whiteness of the recording sheet.

The relation between the original degree of whiteness of the recording sheet for obtaining target whiteness (in this embodiment, 80%, 90%, 100%, and 110%) and the recording amount of fluorescent-whitening-agent is calculated from the relation shown in FIG. 4A and the calculated relation is shown in FIG. 4B. Lines 406 to 409 indicate the relation between the degree of whiteness of the recording sheet and the recording amount when the target whiteness is 110% to 80%. This is an example in which the spectral distribution of illumination light when the recording sheet is observed is the same as that when the degree of whiteness of the recording sheet is measured. The relation is calculated for other spectral distributions of illumination light by the same method as described above.

Figure 5:
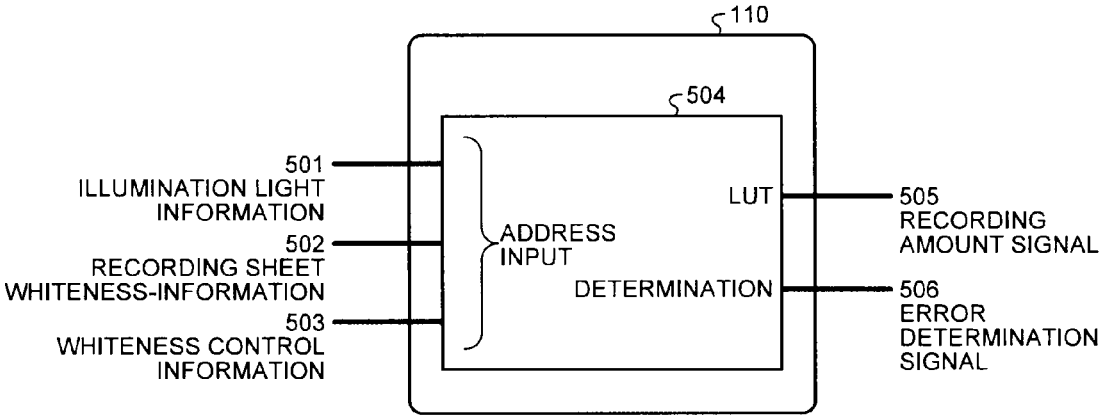
FIG. 5 is a diagram illustrating the structure of a fluorescent-whitening-agent-addition-amount determining unit.

FIG. 5 is a diagram illustrating the detailed structure of the fluorescent-whitening-agent-addition-amount determining unit 110. In FIG. 5, the fluorescent-whitening-agent-addition-amount determining unit 110 includes illumination light information 501 when a recording sheet is observed, recording-sheet-whiteness information 502, the degree of whiteness of the recording sheet 209 estimated by the whiteness sensor 213, whiteness control information 503, and a look-up table (LUT) 504 having the whiteness control ON/OFF setting information of the whiteness setting unit 109 shown in FIG. 3C as an address input.

That is, when the whiteness control information 503 indicates that whiteness control is turned on, the LUT 504 outputs, from an LUT terminal, a recording amount signal 505 represented by a line 408 (90%) of FIG. 4B corresponding to the degree of whiteness of the recording sheet 209 according to the illumination light information 501. When the degree of whiteness of the recording sheet 209 is equal to or more than 100 or equal to or less than 67, the LUT outputs an error determination signal 506 indicating that it is difficult to obtain target whiteness from a determination terminal. This is because it is difficult to satisfy a target whiteness of 100% even though the recording amount signal 505 is controlled (see FIG. 4B).

On the other hand, when the whiteness control information indicates that whiteness control is turned off, the LUT 504 outputs the recording amount signal 505 of "0" from the LUT terminal such that no fluorescent-whitening-agent is added.

The error determination signal 506 indicating that it is difficult to obtain target whiteness is output to, for example, the whiteness setting unit 109. When receiving the error determination signal 506, the whiteness setting unit 109 blinks the indicator lamp 301-2 to notify the operator that it is difficult to obtain target whiteness.

Figure 6:
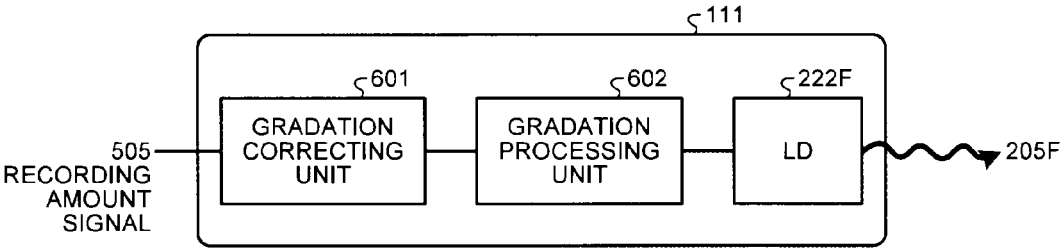
FIG. 6 is a diagram illustrating the structure of a fluorescent-whitening-agent adding unit.

FIG. 6 is a diagram illustrating an example of the detailed structure of a signal processing unit of the fluorescent-whitening-agent adding unit 111. In FIG. 6, the recording amount signal 505 is input to a gradation correcting unit 601. The gradation correcting unit 601 is a block that performs gradation correction using the process performed by a gradation processing unit 602, which will be described below, such that the recording amount of fluorescent-whitening-agent actually added by the image forming unit 206F is equal to the recording amount indicated by the input recording amount signal 505. For example, the gradation correcting unit 601 may be implemented by a one-dimensional LUT.

The gradation processing unit 602 is a block that converts the multi-valued recording amount signal 505 corrected by the gradation correcting unit 601 into a binary LD bias signal. The multi-valued recording amount signal is converted into the binary LD bias signal by, for example, a dither process or an error diffusion method. The binary LD bias signal output from the gradation processing unit 602 is input to an LD 222F of the image forming unit 206F and becomes a laser beam 205F.

Figure 7A:
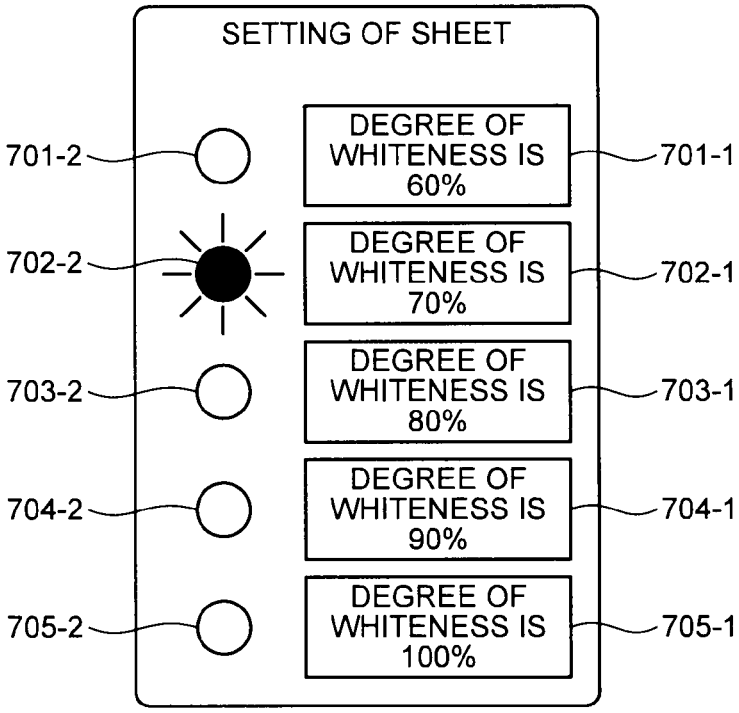
FIGS. 7A and 7B are diagrams illustrating the outward appearance of a recording-sheet-information inputting unit.

The image recording device shown in FIG. 2A includes the whiteness sensor 213 as the recording-sheet-information inputting unit 108, but the embodiment is not limited thereto. FIG. 7A shows an example of the outward appearance of the recording-sheet-information inputting unit 108. Referring to FIG. 7A, key SWs (switches) 701-1 to 705-1 are switches for selecting the degree of whiteness of the recording sheet from 60% to 100%. The operator makes a determination according to the degree of whiteness of the recording sheet used and presses any one of the key SWs 701-1 to 705-1.

The recording-sheet-information inputting unit 108 detects this operation, turns on the corresponding indicator lamps 701-2 to 705-2 to notify the operator that the settings have been recognized, and outputs the whiteness information of the recording sheet to the fluorescent-whitening-agent-addition-amount determining unit 110.

As such, when the user inputs the type of recording sheet, the recording-sheet-information inputting unit 108 shown in FIG. 7A acquires the whiteness information of the recording sheet.

Figure 7B:
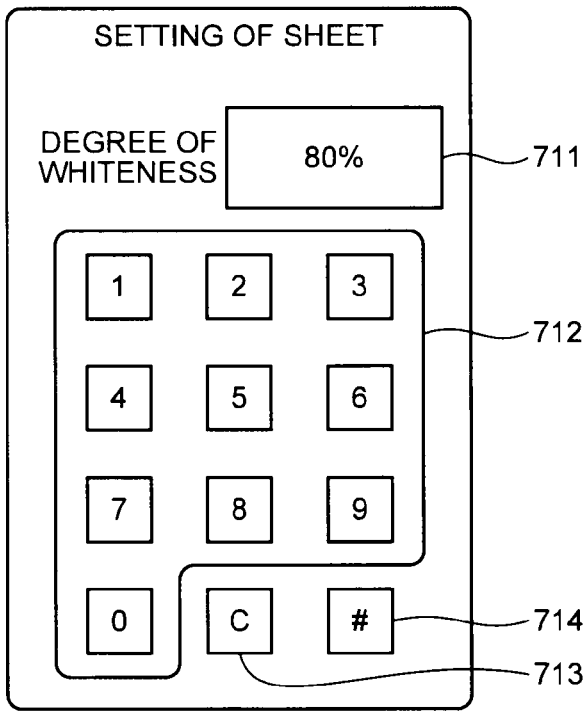

FIG. 7B is a diagram illustrating another example of the outward appearance of the recording-sheet-information inputting unit 108. Referring to FIG. 7B, numeric keys 712 are switches used by the operator to input the degree of whiteness of the recording sheet used. An input value is displayed on a whiteness display unit 711. An enter key 714 is pressed to confirm the degree of whiteness displayed on the whiteness display unit 711. A clear key 713 is pressed to clear the degree of whiteness displayed on the whiteness display unit 711.

When the operation of the enter key 714 is detected, the recording-sheet-information inputting unit 108 outputs the degree of whiteness which is input as the whiteness information of the recording sheet to the fluorescent-whitening-agent-addition-amount determining unit 110.

As such, when the user directly inputs the degree of whiteness of the recording sheet, the recording-sheet-information inputting unit 108 shown in FIG. 7B acquires the whiteness information of the recording sheet.

In an example of the illumination-light-information inputting unit 107, when the operator determines, for example, the type of illumination light during observation, the illumination light when the recording sheet is observed is specified. However, the embodiment is not limited thereto.

Figure 8A:
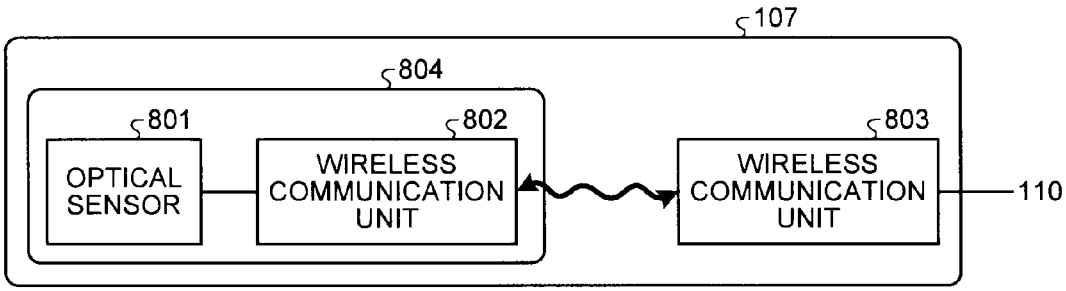
FIGS. 8A to 8D are diagrams illustrating other examples of the structure of an illumination-light-information inputting unit.

FIG. 8A shows another example of the illumination-light-information inputting unit 107. Referring to FIG. 8A, the illumination-light-information inputting unit 107 includes an optical sensor 801 that detects the characteristics of ambient light and wireless communication units 802 and 803 that wirelessly exchange information therebetween. The optical sensor 801 and the wireless communication unit 802 are provided in an observation light detecting unit 804 which is removable and portable. The observation light detecting unit 804 is provided in a place in which the operator observes the recording sheet having a color material recorded thereon.

In this way, the optical sensor 801 detects the characteristics of ambient light when the recording sheet having a color material recorded thereon is observed, and the wireless communication units 802 and 803 output the detected characteristics as illumination light information to the fluorescent-whitening-agent-addition-amount determining unit 110. Since the illumination light when the recorded image is observed is measured, it is possible to achieve a high-accuracy illumination-light-information inputting unit.

Figure 8B:
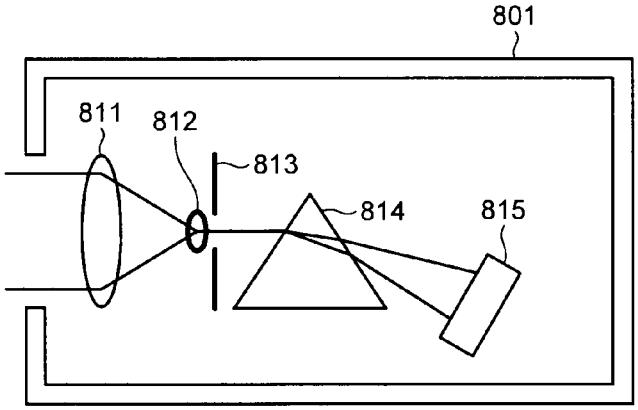

An example of the optical sensor 801 is shown in FIG. 8B. In FIG. 8B, light around the optical sensor 801 is focused by condensing lenses 811 and 812 and a slit 813, becomes a parallel light beam, and is incident on a prism 814.

The light incident into the prism 814 is dispersed by the action of different refractive indexes according to wavelengths and is guided to a CCD 815. The CCD 815 includes light receiving elements which are one-dimensionally arranged and can detect the spectral distribution of ambient light using the light reception intensity of each element.

As described above, according to this embodiment, since the optical sensor 801 that measures illumination light when the recorded image is observed is provided, it is possible to achieve a high-accuracy illumination-light-information inputting unit.

Figure 8C:
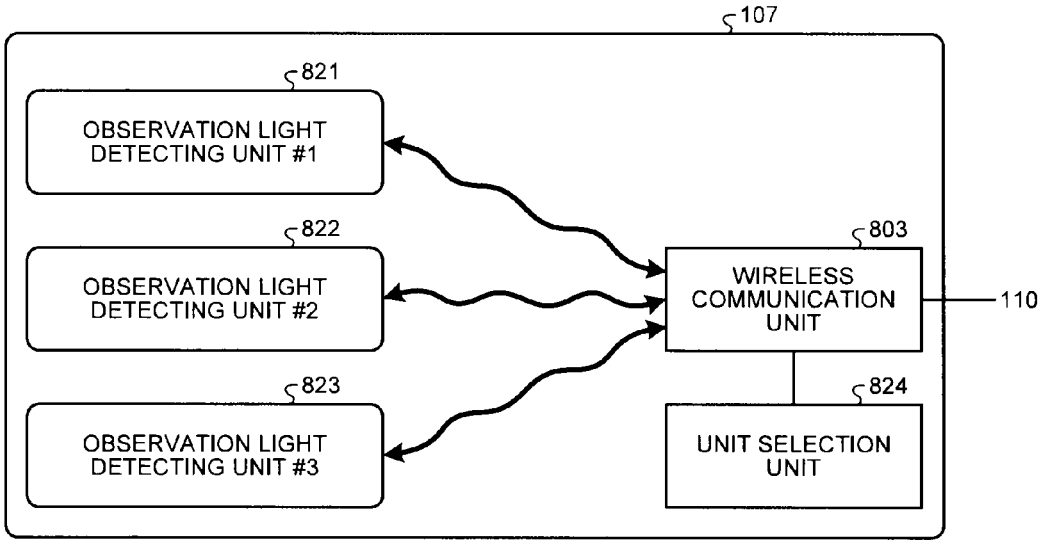

As shown in FIG. 8C, the illumination-light-information inputting unit 107 may include a plurality of observation light detecting units 821 to 823 which detect the characteristics of ambient light and a wireless communication unit 803 which wirelessly exchanges information among the observation light detecting units. The observation light detecting units 821 to 823 are installed by the operator in the places where the recording sheet having a color material recorded thereon is likely to be observed. The illumination-light-information inputting unit 107 includes a unit selection unit 824 which enables the operator to select one of the plurality of observation light detecting units 821 to 823. The operator selects any one of the observation light detecting units 821 to 823 according to the place where the recording sheet having a color material recorded thereon is observed. In this way, the detection result is selected from the observation light detecting units 821 to 823 according the place where the recording sheet having a color material recorded thereon is observed, and the wireless communication unit 803 outputs the selection result as illumination light information to the fluorescent-whitening-agent-addition-amount determining unit 110. In addition, since a corresponding illumination light measuring unit can be selected from the plurality of illumination light measuring units, it is possible to achieve a high-accuracy illumination-light-information inputting unit.

As described above, since this embodiment includes the plurality of observation light detecting units 821 to 823 for measuring illumination light when the recorded image is observed and the unit selection unit 824 for selecting one of the plurality of observation light detecting units 821 to 823, it is possible to select an observation light detecting unit according to the place where the recording sheet having a color material recorded thereon is observed and thus achieve a high-accuracy illumination-light-information inputting unit. The embodiment is not limited to the unit selection unit 824 which selects one of the observation light detecting units 821 to 823 according to the place where the recording sheet having a color material recorded thereon is observed.

Figure 8D:
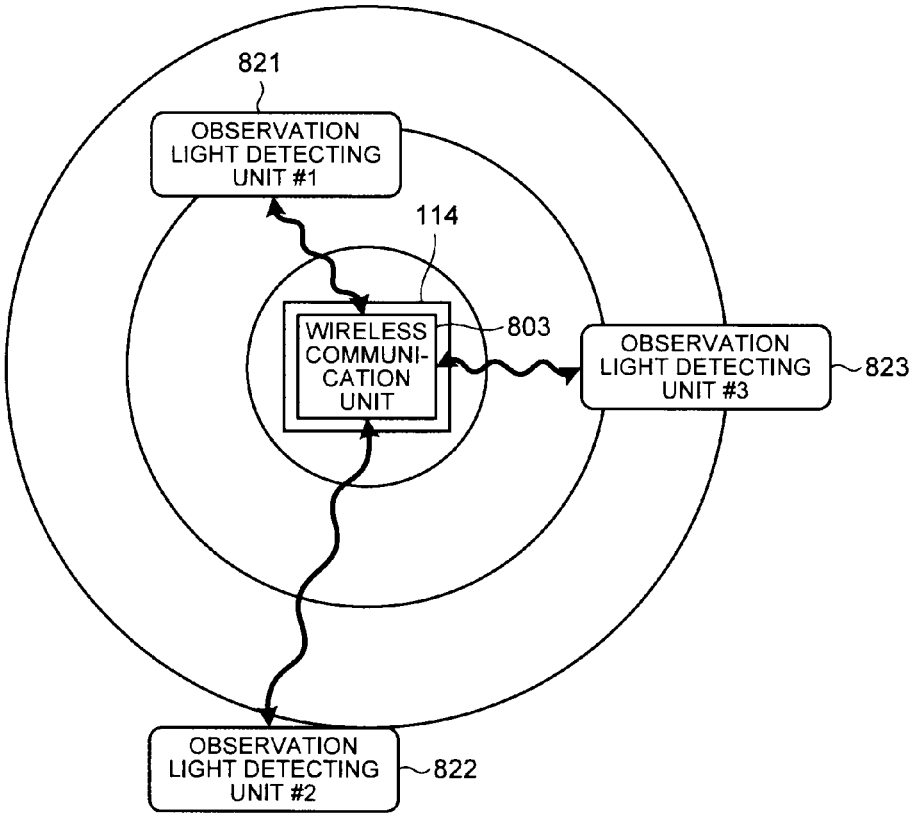

FIG. 8D shows an aspect in which the observation light detecting units 821 to 823 wirelessly exchange information with the PC 114 which transmits compressed/decompressed image data or an image drawing command to the image information inputting unit 101. The PC 114 estimates the distance from each of the observation light detecting units 821 to 823 on the basis of the intensity of wireless signals from the observation light detecting units 821 to 823 and transmits, to the image information inputting unit 101, the information of the observation light detecting unit which is estimated to be closest to the PC 114.

The unit selection unit 824 inquires the image information inputting unit 101 to acquire the information of the observation light detecting unit which is estimated to be closest to the PC 114 and selects the corresponding detection result. The wireless communication unit 803 outputs the selection result as the illumination light information to the fluorescent-whitening-agent-addition-amount determining unit 110.

As described above, according to this embodiment, the detection result of the observation light detecting unit which is estimated to be closest to the PC 114 is selected. In many cases, since illumination light in the vicinity of the PC 114 is identical to illumination light when a recorded image is observed, it is possible to achieve an illumination-light-information inputting unit capable of selecting the most suitable one from the plurality of illumination light measuring units.

Figure 9:
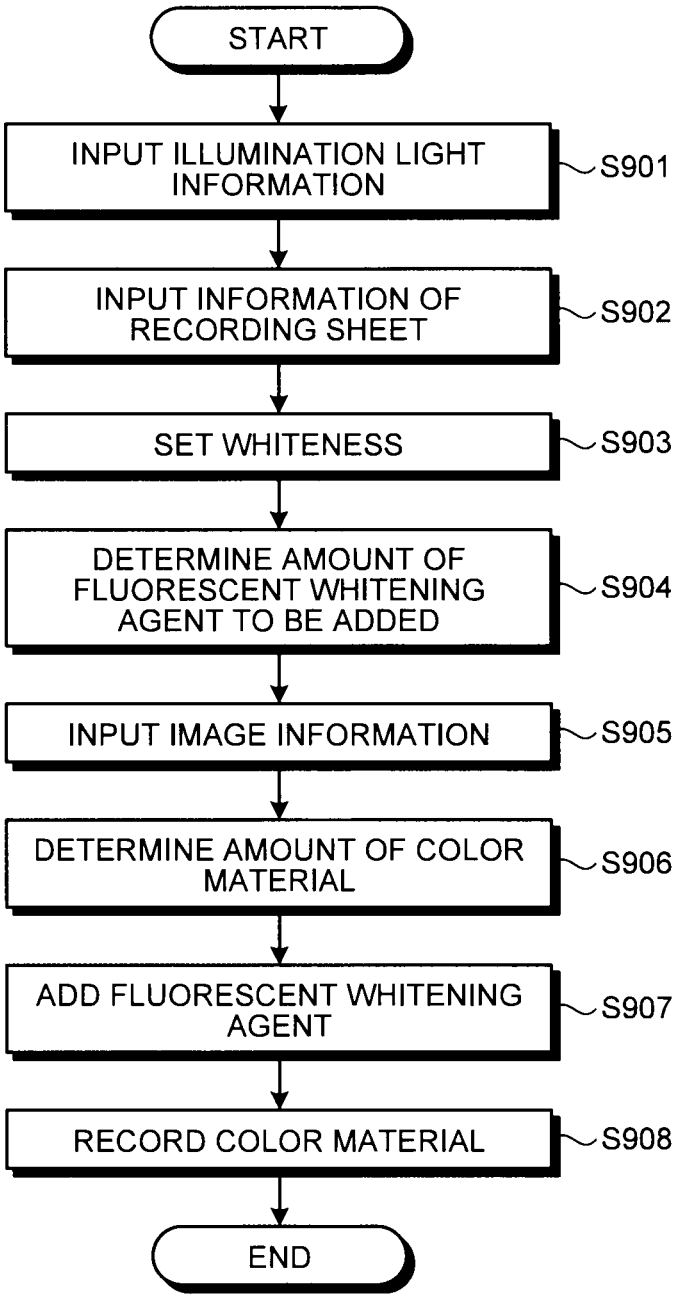
FIG. 9 is a flowchart illustrating a process performed by the image recording device.

FIG. 9 is a flowchart illustrating image processing performed by the image recording device. The whole control unit 106 controls and performs the image processing.

In Step 901, the whole control unit 106 controls the illumination-light-information inputting unit 107 such that the information of illumination light when the recording sheet having a color material recorded thereon is observed is acquired. In this embodiment, for example, a spectral distribution, the type (D50, F2, F8, F10, and the like) of an illumination light source, and a color rendering property/light source color (a common white, a three-wavelength natural white, a high color rendering natural white, and the like) may be acquired to know the spectral distribution of illumination light.

In Step 902, the whole control unit 106 controls the recording-sheet-information inputting unit 108 such that the information of the recording sheet stored in the recording-sheet supply unit 103 is acquired. Here, for example, a photoelectric conversion signal of the whiteness sensor 213 is measured by the reference white board 213-3 and the recording sheet 209 and the degree of whiteness of the recording sheet 209 is calculated.

In Step 903, the whole control unit 106 controls the whiteness setting unit 109 such that the whiteness setting information of the recording sheet when the recording sheet having a color material recorded thereon is observed is acquired. Here, for example, as shown in FIG. 3D, the user selects whether to set the whiteness of the recording sheet having an image recorded thereon to a specific value and the whiteness setting information of the recording sheet is acquired.

In Step 904, the whole control unit 106 controls the fluorescent-whitening-agent-addition-amount determining unit 110 such that the amount of fluorescent-whitening-agent to be added to the recording sheet is determined on the basis of the information of the illumination light acquired in Step 901, the information of the recording sheet acquired in Step 902, and the whiteness setting information acquired in Step 903.

Here, for example, the amount of fluorescent-whitening-agent is converted into a recording amount signal for obtaining specific whiteness by the conversion table represented by a line 408 in FIG. 4B.

In Step 905, the whole control unit 106 controls the image information inputting unit 101 such that RGB bitmap image data is generated. Here, bitmap image data based on the compressed/decompressed image data or the image drawing command received from, for example, the PC is generated.

In Step 906, the whole control unit 106 controls the color-material-amount determining unit 102 such that the image data generated in Step 904 is converted into image data for the recording amount of CMYK color materials in the image recording device.

In Step 907, the whole control unit 106 controls the fluorescent-whitening-agent adding unit 111 such that the amount of fluorescent-whitening-agent determined in Step 904 is added to the recording sheet. Here, the recording sheet is supplied from the recording-sheet supply unit 103 and the fluorescent-whitening-agent is added to the recording sheet by a recording system, such as an electrophotographic system or an ink jet system.

In Step 908, the whole control unit 106 controls the color-material recording unit 104 such that the recording amount of CMYK color materials corresponding to the image data converted in Step 906 is recorded on the recording sheet. Here, color materials are recorded on the recording sheet processed in Step 907 by a recording system, such as an electrophotographic system or an ink jet system.

The embodiment is also achieved as follows: a recording medium on which a program code of software for implementing the functions of the above-described embodiment is recorded is supplied to a system or an apparatus and a computer (a CPU or an MPU) of the system or the apparatus reads the program code recorded on the recording medium. In this case, the program code read from the recording medium implements the functions of the above-described embodiment. For example, a hard disk, an optical disk, a magneto-optical disk, a non-volatile memory card, or a ROM may be used as the recording medium for supplying the program code. The computer executes the read program code to implement the functions according to the above-described embodiment. In addition, an operating system (OS) operated on the computer may perform some or all of the actual processes on the basis of instructions from the program code and the functions according to the above-described embodiment may be implemented by the processes. The program code read from the recording medium may be written to a memory of a function extension board inserted into the computer or a function extension unit connected to the computer, a CPU included in the function extension board or the function extension unit may perform some or all of the actual processes on the basis of instructions from the program code, and the functions according to the above-described embodiment may be implemented by the processes. A program for implementing the functions according to the above-described embodiment may be provided from a server by communication through a network.

According to the embodiment, even when the intensity of illumination light is changed during observation, it is possible to record an image with an appropriate degree of whiteness since the amount of fluorescent-whitening-agent added is controlled on the basis of the illumination light during observation.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image recording device that records an image on a recording sheet based on input image information, the image recording device comprising:

an illumination-light-information inputting unit that inputs information of illumination light when the recorded image is observed;

a whiteness setting unit that sets a whiteness of the recording sheet when the recorded image is observed;

an addition amount determining unit that determines an amount of fluorescent-whitening-agent to be added to the recording sheet based on the input information of the illumination light and the whiteness that is set; and a fluorescent-whitening-agent adding unit that adds an amount of fluorescent-whitening-agent onto the recording sheet according to the determined amount of fluorescent-whitening-agent, wherein the illumination-light-information inputting unit includes an illumination light measuring unit that measures the illumination light when the recorded image is observed, wherein the illumination-light-information inputting unit includes a plurality of the illumination light measuring units and a selection unit that selects one of the plurality of the illumination light measuring units, and wherein the selection unit selects an illumination light measuring unit which is closest to an input source of the image information.

2. The image recording device according to claim 1, wherein the illumination-light-information inputting unit includes an illumination light source specifying unit that specifies a light source used for illumination when the recorded image is observed.

3. The image recording device according to claim 1, further comprising:

a recording-sheet-information inputting unit that inputs information of the recording sheet.

4. An image recording method that records an image on a recording sheet based on input image information, the method comprising:

inputting information of illumination light when the recorded image is observed;

setting a whiteness of the recording sheet when the recorded image is observed;

determining an amount of fluorescent-whitening-agent to be added to the recording sheet based on the input information of the illumination light and a set whiteness that is set at the setting; and adding fluorescent-whitening-agent to the recording sheet according to an amount of fluorescent-whitening-agent determined at the determining, wherein the inputting includes inputting a measured illumination light when the recorded image is observed, wherein prior to the inputting the method comprises selecting one of a plurality of illumination light measuring devices, and wherein the selecting selects an illumination light measuring device which is closest to an input source of the image information.

5. A computer program product comprising a non-transitory computer-usable medium having computer-readable program codes embodied in the medium for image recording in an image recording device, the program codes, when executed, causing a computer to execute the image recording method according to claim 4.

* * * * *